United States Patent [19]

Irie et al.

[11] Patent Number: 4,496,400

[45] Date of Patent: Jan. 29, 1985

[54] THIN STEEL SHEET HAVING IMPROVED BAKING HARDENABILITY AND ADAPTED FOR DRAWING AND A METHOD OF PRODUCING THE SAME

[75] Inventors: Toshio Irie, Chiba; Susumu Sato, Ichihara, both of Japan

[73] Assignee: Kawasaki Steel Corporation, Kobe, Japan

[21] Appl. No.: 395,049

[22] PCT Filed: Oct. 19, 1981

[86] PCT No.: PCT/JP81/00289

§ 371 Date: Jun. 16, 1982

§ 102(e) Date: Jun. 16, 1982

[87] PCT Pub. No.: WO82/01566

PCT Pub. Date: May 13, 1982

[30] Foreign Application Priority Data

Oct. 18, 1980 [JP] Japan ..... 55-145951
Oct. 28, 1980 [JP] Japan ..... 55-150053
Nov. 25, 1980 [JP] Japan ..... 55-165536

[51] Int. Cl.[3] ..... C21D 8/04

[52] U.S. Cl. ..... 148/12 C; 148/12.4; 148/36

[58] Field of Search ..... 148/12 C, 12 D, 12 F, 148/36, 12.3, 12.4

[56] References Cited

U.S. PATENT DOCUMENTS 4,050,959 9/1977 Nakaoka et al. ..... 148/12.3
4,062,700 12/1977 Hayami et al. ..... 148/12.3
4,113,523 9/1978 Uchida et al. ..... 148/12.3
4,315,783 2/1982 Akisue et al. ..... 148/12 C
4,339,284 7/1982 Hashimoto et al. ..... 148/12 F

FOREIGN PATENT DOCUMENTS 94446 7/1980 Japan ..... 148/12 F
49137 12/1980 Japan ..... 148/12 C
WO80/1811 9/1980 PCT Int'l Appl. ..... 148/12 F

*Primary Examiner*—Peter K. Skiff
*Attorney, Agent, or Firm*—Balogh, Osann, Kramer, Dvorak, Genova & Traub

[57] ABSTRACT

The present invention belongs to a technical field of cold rolled steel sheet. The present invention provides a thin steel sheet suitable to be formed into, for example, an external automotive plate by a method including an appearance-finishing step by bake coating as a final step after drawing (such as press molding). The present invention aims to improve remarkably the yield strength, so-called bake hardenability, of the thin steel sheet in order to produce advantageously a light weight automobile. In addition, the invention aims to compensate advantageously the deterioration of dent resistance of the automobile due to the lowering of the weight, without deteriorating the $\bar{r}$ value, which is an indication of the press moldability of the thin steel sheet. Accordingly, the present invention discloses an effective compounding amount of Nb, which acts to fix C and N in the steel in the presence of a proper amount of Al, and an annealing condition capable of developing effectively the contribution of Nb.

11 Claims, 3 Drawing Figures

THIN STEEL SHEET HAVING IMPROVED BAKING HARDENABILITY AND ADAPTED FOR DRAWING AND A METHOD OF PRODUCING THE SAME

TECHNICAL FIELD

Cold rolled steel sheets or zinc-plated steel sheets produced from the cold rolled steel sheet are used as an exterior automotive plate in a large amount. These steel sheets are subjected to a drawing treatment, such as a press molding, and then to a bake coating at the use, and these steel sheets for drawing can satisfy advantageously the demand for dent resistance by improving the yield strength due to the heating during the bake coating, that is, by improving so-called baking hardenability. The baking hardenability is evaluated by the BH value of the total increased value of yield strength of a steel sheet in the case where the steel sheet is prestrained under a tension of 2% and then subjected to a heat treatment of 170° C. for 20 minutes. The baking hardenability of a steel sheet must be improved without deteriorating the drawability represented by the Lankford value $\bar{r}$.

The present invention belongs to a technical field relating to a thin steel sheet adapted for drawing and having high $\bar{r}$ value and BH value, which is produced from a cold rolled steel sheet, particularly from a high tensile strength cold rolled steel sheet; or from a metal- or alloy-plated steel sheet produced from these cold rolled steel sheets and having a plated film on at least one surface, the metal- or alloy-plated steel sheet being hot dip plated steel sheet, particularly zinc hot dip plated steel sheet, whose plated zinc film may be formed into alloy, aluminum plated steel sheet, lead-tin plated (terne plated) steel sheet and the like, and to a method of producing the thin steel sheet.

BACKGROUND ART

Rimmed steel has been used for a long period of time due to its excellent surface property for obtaining beautiful finishing of coating. The rimmed steel has an ageing property at room temperature due to the presence of nitrogen solid solved therein, and when the rimmed steel is press molded just after the cold rolling, the yield strength is increased due to the strain ageing by nitrogen without generation of stretcher-strain at the bake coating.

Recently, continuous casting technic of steel has been progressed and developed, and a large amount of aluminum killed steel having a moldability superior to that of rimmed steel is used in place of rimmed steel as a thin steel sheet for drawing, which is mainly used for exterior automotive plate.

Aluminum killed thin steel sheet is excellent in the deep drawing property, but is generally poor in the baking hardenability due to the presence of nitrogen fixed by aluminum.

While, when it is intended to use high tensile strength steel sheet in order to produce automobiles having a light weight, it is necessary to give baking hardenability, particularly an improved baking hardenability, to the high tensile strength steel sheet in order to compensate the decreasing of the dent resistance due to the decreasing of the sheet thickness from the view point of safety.

Ferrite-martensite dual phase steel sheet has a satisfactorily high baking hardenability, but has generally a low $\bar{r}$ value of about 1.0, and is poor in the drawability. Therefore, the use field of ferrite-martensite dual phase steel sheet is limited.

While, in order to produce a thin steel sheet having a high $\bar{r}$ value, there have been proposed the following treatments. That is, aluminum killed cold rolled steel sheet, which has been strengthened by adding phosphorus thereto, is subjected to an open coil annealing and solid solved carbon is left in the steel to develop the strain ageing property by utilizing such a property that the open coil annealed steel can be cooled at a rapid cooling rate. Alternatively, the aluminum killed cold rolled steel sheet is subjected to a tight coil annealing at a particularly high temperature to form coarse carbide and to disturb the precipitation of solid solved carbon, whereby solid solved carbon is left in the steel (for example, refer to Iron and Steel, Vol. 66, page A209 (1980)). However, in the former method, additional treating steps, wherein the steel sheet is rewound into an open coil and into a tight coil before and after annealing respectively, must be carried out. While, in the latter method, fusing of the adjacent layers of the coiled steel sheet occurs and further the inner cover (retort) of the annealing furnace is thermally deformed. Therefore, the production cost is very high. Moreover, it has been found that the phosphoruscontaining low carbon aluminum killed steel sheet, that is, so-called rephos steel, which has been subjected to the above described treatments, is not always satisfactory in the $\bar{r}$ value and yield strength.

While, a steel sheet having a high $\bar{r}$ value and a low yield point, which is produced by adding Ti, Nb and the like to extra low carbon steel to fix C and N, and by adding P, and the like thereto to form a solid solution and to strengthen the steel, is used in the automotive parts more widely than the above described steel. However, the steel has a low yield strength and a high tensile strength, and therefore when plastic strain is applied to the steel, the steel has a remarkably high hardenability in the working. However, it is impossible to cause uniform plastic deformation over an entire working range of the molding by a press mold depending upon the shape of parts produced by the molding. Accordingly, the portion, to which a low plastic strain is applied, still has a low yield strength, and is easily deformed by a small external force.

In order to obviate the above described drawbacks, there have been attempts to give the baking hardenability to such steel. That is, Japanese Patent Laid-Open Application No. 114,717/78 discloses Ti addition, Japanese Patent Application Publication No. 30,528/76 discloses Zr addition and Japanese Patent Laid-Open Application No. 130,819/74 discloses Nb addition. In all these methods, Ti, Zr and the like are contained in a steel in an amount a little smaller than the amount of C+N in order that C and N in the steel are not completely fixed but solid solved C and N are left in the steel in an amount not to cause deterioration of deep drawing property while directing to the prevention of ageing at room temperature, and further the steel is cooled at a cooling rate, which does not cause carbide and nitride of iron precipitated in the relatively low temperature region in the cooling step after the annealing.

However, even in these methods, a little amount of solid solved C and N is always contained in the steel sheet before the cold rolling and at the rovery-recrystallization step after annealing. Therefore, the steel has a serious drawback that the development of aggregation structure suitable for $\bar{r}$ is hindered. Therefore, it has been difficult to give a baking hardenability to the steel while maintaining a high $\bar{r}$ value.

For example, as to Nb addition, according to the above described Japanese Patent Laid-Open Application No. 130,819/74, and Nb-containing steel, which contains, in % by weight, 0.004% of C, 0.03% of Al and 0.062% of Nb, is hot rolled, continuously annealed at a uniform temperature of 800° C., whereby a steel sheet having an age hardening value of 17.8 kg/cm$^2$ is obtained (by treatment of prestraining under 3% tension and then artificial ageing treatment at 200° C. for 30 minutes). However, the $\bar{r}$ value is only about 1.71, and further the amount of Nb is excessively large as compared with the amount of C, and the steel sheet is low in the elongation and is not satisfactory in the ductility.

The inventors have already found out that, when a steel sheet containing Nb in an amount smaller than the equivalent amount, calculated as Nb, to the amount of C is hot rolled at high speed and at high reduction rate, a steel sheet having non-ageing property, deep drawing property and more improved ductility can be obtained; and further found out that the use of phosphorus as a solid solution strengthening element under the above described condition is effective for improving the deep drawing property without adverse influence upon the $\bar{r}$ value. Based on the experience, the inventors have further studied how to give baking hardenability to steel and how to improve the baking hardenability and reached the present invention described hereinafter.

DISCLOSURE OF THE INVENTION

The inventors have found out that Nb must be contained in a steel in an amount of at least 3 times amount of C contained in the steel in order to secure an $\bar{r}$ value of at least 1.5 which is a necessary amount in order to use the steel sheet as a steel sheet for drawing, and in an amount of substantially not more than 8 times amount of C contained in the steel in order to obtain a bake hardening degree of BH value of at least 5 kg/mm$^2$, which is defined as a total increased value of yield strength of a steel sheet in the case where the steel sheet is prestrained under a tension of 2% and then subjected to an ageing treatment at 170° C. for 20 minutes; that a high temperature continuous annealing at a temperature of not lower than 750° C. is effective for obtaining high $\bar{r}$ value and high ductility; and that in this case a part of fixed C and N is solid solved during the high temperature heating, and the solid solved C and N are reprecipitated at a particularly high precipitation speed at a temperature region of not lower than 650° C. during the cooling step after annealing, and therefore the baking hardenability of the steel sheet can be remarkably improved by controlling the average cooling rate down to a temperature of not higher than 650° C. to at least 10° C. per second, preferably at least 30° C. per second. As the result, the inventors have accomplished the following first and second aspects of the present invention.

The first aspect of the present invention:

A thin steel sheet having high baking hardenability and adapted for drawing, having a composition consisting of 0.002–0.008% by weight of C; 0.05–1.2% by weight of Mn; not more than 0.5% by weight of Si; not more than 0.10% by weight of P; 0.01–0.1% by weight of Al, said amount being not less than 8 times amount of N incidentally incorporated into the steel; Nb in an amount within the range of from ((C content)×3) to ((C content)×8+0.02)% by weight; and the remainder being substantially Fe, and having an $\bar{r}$ value of at least 1.5, an ageing index of not higher than 4 kg/mm$^2$ and a bake-hardening degree of at least 5 kg/mm$^2$.

The second aspect of the present invention:

A method of producing a thin steel sheet having a high baking hardenability and adapted for drawing, comprising forming a molten steel having a composition containing 0.002–0.008% by weight of C; 0.05–1.2% by weight of Mn; not more than 0.5% by weight of Si; not more than 0.10% by weight of P; 0.01–0.08% by weight of Al, said amount being not less than 8 times amount of N incidentally incorporated into the steel; and Nb in an amount within the range of from ((C content)×3) to ((C content)×8+0.02)% by weight into a slab, hot rolling the slab, cold rolling the hot rolled sheet, subjecting the cold rolled sheet to a continuous annealing under a condition of a temperature of 750°–900° C. and a time of at least 10 seconds, and cooling the annealed sheet under a condition that the annealed sheet is cooled to a temperature of not higher than 650° C. at an average cooling rate of at least 10° C. per second, preferably at least 30° C. per second.

The inventors have further limited the lower and upper limits of the amount of caribide- and nitride-forming elements of Al and Nb as follows. That is, the lower limit of the amount of Al and Nb is limited to such an amount which can make the solid solved amount of C and N into substantially zero in the hot rolled sheet before cold rolling and in the cold rolled sheet before recovery and recrystallization during the annealing; and the upper limit thereof is limited to such an amount that a proper amount of the carbide and nitride of Al and Nb is dissolved in the steel sheet at the higher temperature side within the range of from the recrystallization temperature to the $Ac_3$ point. Further, following to the annealing carried out within the above described temperature range, the annealed sheet is cooled at a cooling rate which does not precipitate again the above described dissolved carbide and nitride during the cooling. As the result, the inventors have succeeded in the production of a thin steel sheet having improved baking hardenability while maintaining the excellent press moldability. The inventors have further made various investigations based on the discovery, and found out that, when the hot rolling condition is properly selected, a thin steel sheet, which contains a small amount of Nb, has well balanced $\bar{r}$ value and elongation and further has stable baking hardenability and excellent surface property, can be advantageously produced in a high yield with regard to addition element and in a low production cost. As the result, the inventors have reached the following third and fourth aspects of the present invention.

The third aspect of the present invention:

A thin steel sheet for drawing, having a composition consisting of 0.002–0.015% by weight of C; 0.04–1.5% by weight of Mn; not more than 1.2% by weight of Si; not more than 0.10% by weight of P; 0.001–0.01% by weight of N; 0.01–0.10% by weight of Al; Nb in an amount within the range from ((C content)×2) to ((C content)×8+0.02)% by weight; and the remainder being substantially Fe, and having an $\bar{r}$ value of at least 1.5, an ageing index of not higher than 4 kg/mm$^2$ and a bake-hardening degree of at least 5 kg/mm$^2$.

The fourth aspect of the present invention:

A method of producing a thin steel sheet having a high baking hardenability and adapted for drawing, comprising forming a molten steel having a composition containing 0.002–0.015% by weight of C; 0.04–1.5% by weight of Mn; not more than 1.2% by weight of Si; not more than 0.10% by weight of P; 0.001–0.01% by weight of N; 0.01–0.10% by weight of Al; and Nb in an amount within the range of from ((C content)×2) to ((C content)×8+0.02)% by weight into a slab, hot rolling the slab, cold rolling the hot rolled sheet, subjecting the cold rolled sheet to a continuous annealing at a uniform temperature between 900° C. and the $Ac_3$ point, and cooling the annealed sheet under a condition that the annealed sheet is cooled to a temperature of not higher than 600° C. at an average cooling rate of at least 1° C. per second, preferably at least 10° C. per second.

Among the above described thin steel sheets, ones used for automobile, particularly for external automotive plates, are often required to be plated with zinc or other metals in order to satisfy the demand of high corrosion resistance. In this case, the plating is carried out by a hot dip plating, particularly by a zinc hot dip plating, which is followed by an alloy treatment thereof, due to its simple treating step, and therefore the steel sheet has the heat history before its press molding. The inventors have investigated a condition capable of producing a thin steel sheet having excellent press moldability together with high baking hardenability even in the case where the steel sheet has the heat history, and accomplished the following fifth aspect of the present invention.

The fifth aspect of the present invention:

A method of producing a thin steel sheet having a high baking hardenability, adapted for drawing and adapted to be used as a starting sheet for plating, comprising forming a molten steel having a commposition containing 0.002–0.015% by weight of C; 0.04–1.5% by weight of Mn; not more than 0.5% by weight of Si; not more than 0.10% by weight of P; 0.001–0.01% by weight of N; 0.01–0.10% by weight of Al; and Nb in an amount within the range of ((C content)×2) to ((C content)×8+0.02)% by weight into a slab, hot rolling the slab, cold rolling the hot rolled sheet, subjecting the cold rolled sheet to a continuous annealing at a uniform temperature between 900° C. and the $Ac_3$ point, and cooling the annealed sheet under a condition that the annealed sheet is cooled to a temperature of not higher than 600° C. at an average cooling rate of at least 1° C. per second, preferably at least 10° C. per second.

As already explained, phosphorus is an effective element as a solid solution strengthening element, but has an adverse influence upon the quality of steel. Therefore, in the above described aspects of the present invention, the amount of phosphorus has been limited to not more than 0.10% by weight. However, the inventors have made various experiments and investigators, and found out that, when the upper limit amount of Nb is properly limited and the average cooling rate of annealed sheet during the cooling step following to the continuous annealing is controlled to a higher cooling rate, the use of up to 0.12% by weight of phosphorus can exhibit a solid solution strengthening effect and can improve the tensile strength of the resulting thin steel sheet up to more than about 45 kg/mm$^2$ without particular troubles, and have accomplished the following sixth aspect of the present invention.

The sixth aspect of the present invention:

A thin steel sheet for drawin, having a composition consisting of 0.002–0.015% by weight of C; 0.04–1.5% by weight of Mn; not more than 1.2% by weight of Si; not more than 0.12% by weight of P; 0.001–0.01% by weight of N; 0.01–0.10% by weight of Al; Nb in an amount within the range of from ((C content)×2) to ((C content)×6)% by weight; and the remainder being substantially Fe, and having an $\bar{r}$ value of at least 1.5, an ageing index of not higher than 4 kg/mm$^2$ and a bake-hardening degree of at least 5 kg/mm$^2$.

The composition of the thin steel sheet of the present invention is limited to the above described range based on the following technical reason.

C: C is required in an amount of at least 0.002% by weight in order to cause strain ageing. However, it has been found from a laboratory scale rolling experiment that, when an excessively large amount of C is used, a large amount of Nb is required in order to fix the C and a large amount of precipitates is formed and the deterioration of processability of the resulting thin steel sheet cannot be prevented. Therefore, the upper limit of the C content is limited to 0.008% by weight in the first and second aspects of the present invention. Further, according to the investigation for practical hot rolling under high speed and high reduction rate, for example, by a tandem mill, the upper limit of the C content is limited to 0.015% by weight in the third and fourth aspects of the present invention.

N: N serves to promote the strain ageing similarly to C. Therefore, N can be contained in an amount of up to about 0.001% by weight, which amount is an incidentally mixed amount. However, when the amount of N exceeds 0.01% by weight, a large amount of Al and Nb must be used and affects adversely the quality of the steel. Therefore, even when it is intended to contain N in a steel, the content of N is limited to not more than 0.01% by weight.

Mn: Mn is combined with S to prevent so-called red-shortness of steel. Mn further acts as a solid solution strengthening element. Therefore, Mn must be contained in a steel sheet in an amount of at least 0.04% by weight. However, when the Mn content exceeds 1.2% by weight, particularly, exceeds 1.5% by weight, the processability of the steel sheet is deteriorated, and therefore the Mn content in the steel sheet is limited depending upon the purpose.

Si: Si serves for the solid solution strengthening of steel and is effective for giving high tensile strength to steel sheet. However, Si hinders the plate adhesion, and therefore the steel sheet to be plated is limited to steel sheets having an Si content of not more than 0.5% by weight, preferably not more than 0.3% by weight. While, when the Si content exceeds 1.2% by weight, the steel sheet is poor in the ductility. Therefore, the Si content must not exceed 1.2% by weight.

P: P gives a high hardenability to steel and is lower than Si and Mn in the influence upon the deep drawability of steel sheet. Therefore, P is used as a very effective solid solution strengthening element in an amount of about not less than 0.03% by weight, but the P content of more than 0.1% by weight cannot prevent the stiffening in the secondary working. Therefore, the P content is fundamentally not more than 0.1% by weight. However, when the upper limit of Nb content is strictly limited and the average cooling rate of continuously annealed steel sheet during its cooling step is controlled to a higher cooling rate as explained later, the P content of up to 1.2% by weight can serve to produce a high tensile strength steel sheet without accompanying the above described drawbacks. Therefore, the upper limit of Si content is limited to 1.2% by weight in the present invention.

Al: Al must be contained in steel in an amount of at least 0.01% by weight in order to develop its deoxidation effect and further to fix effectively N. However, the upper limit of Al content is limited to 0.1% by weight in order to avoid the stiffening of steel and the disadvantage due to the increase of inclusions in the steel.

Nb: Nb is an indispensable element for fixing C. However, when the Nb content is less than its lower limit, an excessively large amount of solid solved C remains in the steel, and an aggregation texture which serves to improve the drawability, cannot be fully developed during the cold rolling and recrystallization. Therefore, the Nb content is particularly preferred to be not less than 3 times amount of C content. However, when a starting slab is hot rolled at high temperature and at high reduction rate, if the Nb content is 2 times amount of C content, which content does not substantially form solid solution C in the steel sheet before recovery-recrystallization after the cold rolling following to the hot rolling, the aggregation texture can be satisfactorily developed. While, when the Nb content is larger than ((C content)$\times 8+0.02$)% by weight, even in the case where the steel sheet is uniformly heated at high temperature, a baking hardenability cannot be given to the steel sheet. Therefore, Nb content is limited to the above described range. When the P content is increased to 1.2% by weight, the Nb content is limited to about 6 times amount of C content.

The starting steel ingot can be produced by any of open hearth, top or bottom blowing converter and electric furnace. However, bottom blowing converter is advantageously used, which converter is adapted to be used in the blowing of extra low carbon steel. The resulting molten steel, after smelting, is occasionally subjected to a vacuum degassing treatment, such as RH or DH, is mixed with the above described alloy elements, and then is formed into a slab. In the production of the slab, the molten steel may be made into an ingot and then slabbed, or the molten steel may be directly made into a slab by a continuous casting. It is commercially advantageous to hot roll the resulting slab by a tandem system which limits the rolling speed to at least 40 m/min and the total reduction rate to at least 90%, under the same condition as that carried out in the ordinary hot strip mill.

The above described tandem system hot rolling is advantageous, because even when Nb is used in an amount smaller than the amount capable of fixing completely C in the steel in the form of NbC, the amount of solid solved C contained in the hot rolled sheet before the cold rolling and recrystallization can be decreased to be substantially zero.

The lower coiling temperature of hot rolled sheet serves to improve the baking hardenability of the sheet; while the higher coiling temperature thereof serves to improve the drawing property of the sheet. However, the coiling temperature is not particularly limited.

The hot rolled sheet is pickled, and then subjected to cold rolling. At least 60% of reduction rate is generally necessary in order to obtain an $\bar{r}$ value of at least 1.5; while more than 90% of reduction rate causes anisotropy in the resulting thin steel sheet. Therefore, 70–85% of reduction rate is particularly preferably used.

The cold rolled sheet is continuously annealed in the following manner. The cold rolled sheet is heated at a temperature within the range of 750°–900° C. for at least 10 seconds, and then quenched to a temperature of not higher than 650° C. at an average cooling rate of at least 10° C. per second (second aspect); or the cold rolled sheet is uniformly heated to a temperature within the range of from 900° C. to the $Ac_3$ point, and then cooled to a temperature of not higher than 600° C. at an average cooling rate of at least 1° C. per second (fourth and fifth aspects). In the above described methods, when it is intended to obtain a thin steel sheet having a high tensile strength by containing a large amount of phosphorus in the steel sheet, the quenching of the annealed sheet is carried out at a high cooling rate of at least 30° C. per second. Of course, the above described quenching can be continued to room temperature. However, when gas jet is used as a general cooling means, a large amount of energy is required in the quenching at a low temperature region, and therefore slow cooling is preferably carried out within the temparature range of not higher than 650° C. or of not higher than 600° C. Further, quenching sometimes increases ageing property of steel at room temperature depending upon the quenching condition, and the resulting thin steel sheet has sometimes has an ageing index of not higher than 4 kg/mm$^2$. In this case, slow cooling is carried out within the temperature range of 450°–300° C. to decrease the ageing index, or a supplementary treatment, such as overageing treatment, is carried out to control the amount of temporarily solid solved C and to decrease the ageing index.

When the cooling rate is controlled in the above described manner, the reprecipitation of carbide and nitride can be prevented during the cooling step after annealing, and a bake-hardening degree of BH value of at least 5 kg/mm$^2$ can be surely obtained without deterioration of $\bar{r}$ value.

The above treated steel sheet contains solid solved C and N in an amount not to affect adversely the ageing property at room temperature, and often causes a small amount of yield point elongation. Therefore, the above treated steel sheet can be occasionally subjected to a skin-pass rolling at a reduction rate of about 0.2–2% in order to prevent the yield point elongation and to adjust concurrently the surface roughness. Moreover, when the Si content is limited to not more than 0.5% by weight, preferably not more than 0.3% by weight, the above described bake-hardening degree can be obtained together with a sufficiently high plate adhesion and with an improved corrosion resistance due to the plate adhesion even after heat history of hot dip plating treatment of zinc or the like.

As described above, according to the present invention, thin steel sheets for drawing, high tensile strength cold rolled thin steel sheets and thin steel sheets for hot dip plating, which have excellent press moldability and high baking hardenability, can be stably produced, and these thin steel sheets can be used as a thin steel sheet for automobile, which is recently demanded in a large amount, and can satisfy demand for decreasing the weight of the car body and for improving the safety thereof.

BEST MODE OF CARRYING OUT THE INVENTION

Figure 1A:
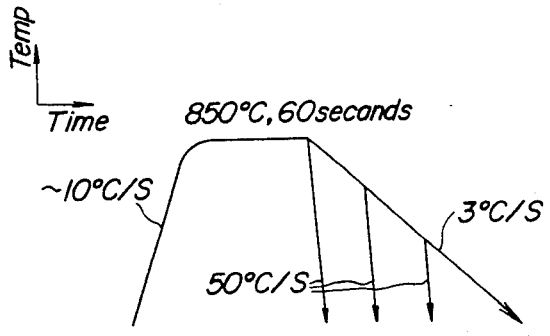
FIG. 1*a* is a diagram illustrating a temperature-time pattern in a continuous annealing of the present invention.

A cold rolled thin steel sheet having a composition containing, in % by weight, 0.005% of C, 0.15% of Mn, 0.01% of Si, 0.07% of P, 0.03% of Al, 0.03% (=[C%]×6) of Nb is heated up to 850° C. at a temperature-raising rate of 10° C. per second according to the temperature-time pattern illustrated in FIG. 1*a*, kept at 850° C. for 60 seconds and then cooled at a rate of 3° C. per second. During the cooling, a starting temperature of quenching, which was carried out at a cooling rate of 50° C. per second, was variously changed as illustrated in FIG. 1*a*, and the variation of the bake-hardening degree (BH value) due to the variation of the quench-starting temperature is shown in FIG. 1*b*.

The BH value was expressed by the increased amount of the yield stress of a steel sheet by a treatment wherein the steel sheet is prestrained under a tension of 2% and then subjected to an ageing treatment at 170° C. for 20 minutes, that is, expressed by the sum of the hardening degree due to the prestrain treatment and the hardening degree due to the above described ageing treatment.

Figure 1B:
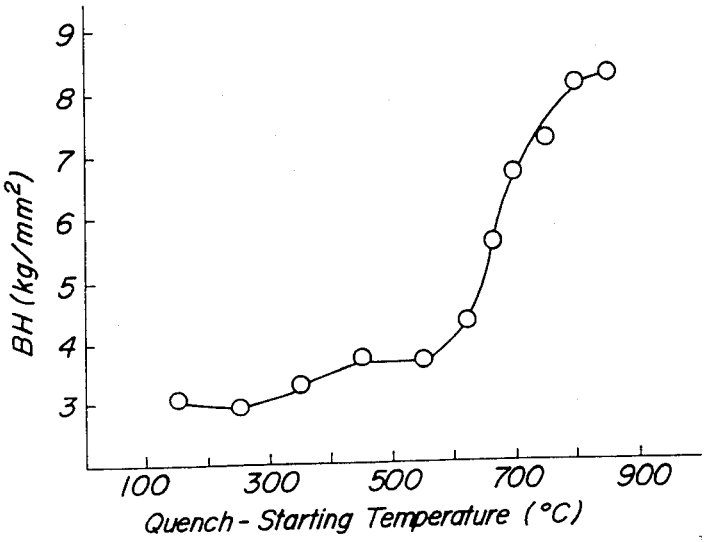
FIG. 1*b* is a graph illustrating a relation between the quench-starting temperature after annealing and the bake-hardening degree in the thin steel sheet of the present invention.

It can be seen from FIGS. 1*a* and 1*b* that, when the above described sample steel sheet is annealed at 850° C. for 60 seconds, and the quenching is started from a temperature of higher than 650° C., the resulting steel sheet has a bake-hardening degree of BH value of at least 5 kg/mm$^2$; while when the annealed sheet is cooled at a rate of about 3° C. per second to a temperature of lower than 620° C., even in the case where the quenching is started from the temperature of lower than 620° C., the resulting steel sheet has a BH value of at most 4.5 kg/mm$^2$. The reason is probably as follows. The C or N solid solved in the steel at the annealing temperature is again bonded with Nb or Al and precipitated during the slow cooling down to a temperature of lower than 650° C.

When a hot rolling is carried out at a relatively low velocity and at a low reduction rate, solid solved C or N is formed during the temperature-raising step of cold rolled sheet before annealing, and a large BH value can be obtained by quenching the annealed sheet in the low temperature region, but the $\bar{r}$ value and ductility of the resulting steel sheet are poor.

Then, the influence of the heating temperature in a continuous annealing upon the $\bar{r}$ value, BH value and other physical properties of a steel sheet was investigated by using a sample thin steel sheet produced in the following manner. A steel sheet having a composition containing, in % by weight, 0.005% of C, 0.15% of Mn, 0.013% of Si, 0.064% of P, 0.006% of S, 0.0032% of N, 0.003% of O, 0.038% of Al and 0.041% (=[%C]×8+0.001%) of Nb was hot rolled, and the hot rolled sheet was coiled at 680° C., pickled and then cold rolled. The cold rolled sheet was raised to a temperature shown in FIG. 2 at an average temperature-raising rate of 15° C. per second, uniformly heated at the temperature shown in FIG. 2, quenched to 600° C. at an average cooling rate of 30° C. per second, which is a somewhat slower cooling rate than that in the above described example, and then subjected to a skin pass rolling at a reduction rate of 0.5% to produce a sample thin steel sheet having a thickness of 0.8 mm. The obtained results are shown in FIG. 2.

Figure 2:
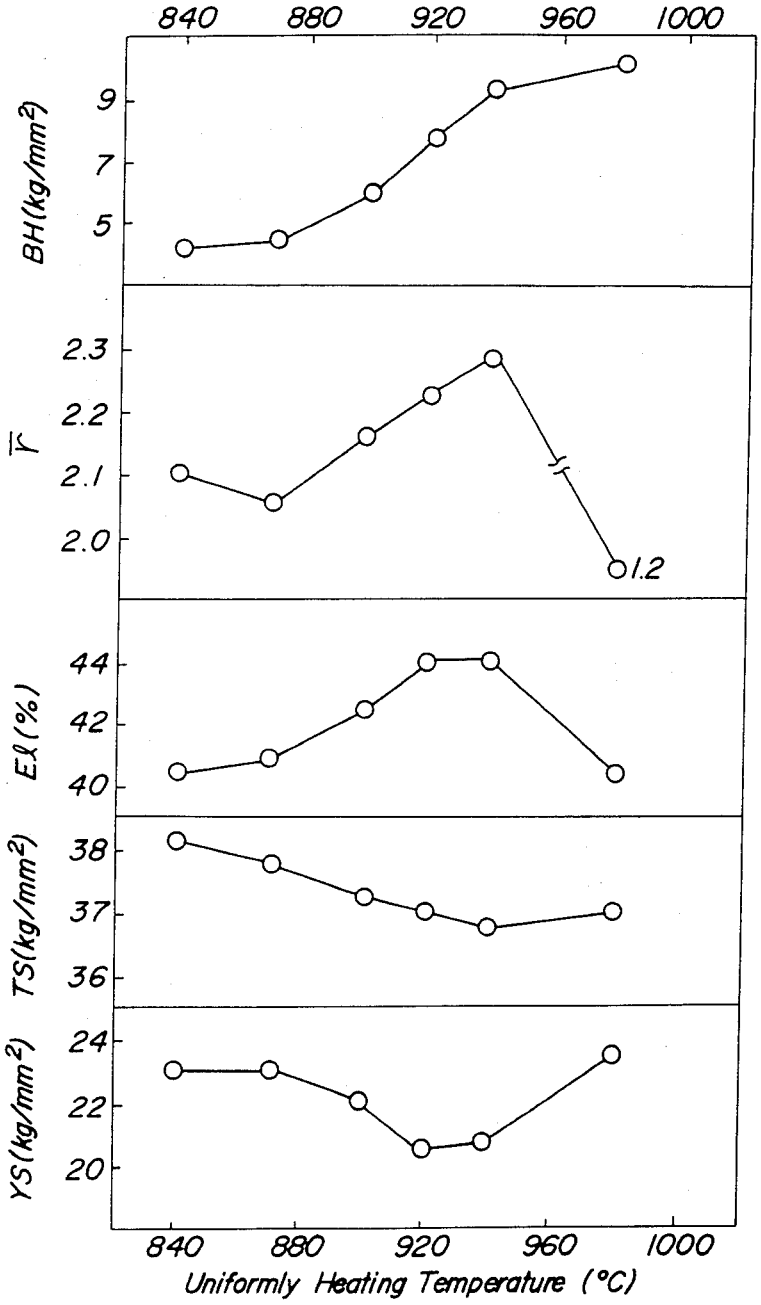
FIG. 2 is a graph illustrating the influence of the annealing temperature upon the bake-hardening degree (BH value), Lankford value ($\bar{r}$ value) and other mechanical properties in a steel sheet under such an annealing and cooling condition that the steel sheet is annealed at a higher annealing temperature and the annealed sheet is cooled at a somewhat slow average cooling rate.

It can be seen from FIG. 2 that, when the uniformly heating temperature is not higher than 950° C., which is the $Ac_3$ point of the sample steel, as the temperature is higher, the yield stress is lower, and the elongation El and the $\bar{r}$ value are higher; and although the tensile stress decreases somewhat, the decreased amount is small. It is noticeable that the baking hardenability is remarkably increased.

A uniform heating of a steel sheet at a temperature of higher than the $Ac_3$ point improves somewhat the baking hardenability but deteriorates noticeably the $\bar{r}$ value and other properties.

As described above, when the annealing of a steel sheet is carried out at a temperature within the range of from 900° C. to the $Ac_3$ point, and the annealed sheet is cooled at a relatively high average cooling rate, the press moldability, which is represented by the $\bar{r}$ value, of the steel sheet is superior to that of a steel sheet obtained by annealing the steel sheet at a temperature of lower than 900° C., and further the BH value is remarkably improved.

When a steel sheet is continuously annealed under a condition of higher temperature side, if the annealed sheet is subjected to a heat history, such as hot dip plating or the like, following to the annealing, substantially the same performance as that described above is maintained in the hot dip plated sheet, and therefore the steel sheet annealed at a higher temperature side is suitable to be used as a starting steel sheet for plating.

A slab having a composition shown in the following Table 1 was hot rolled by means of a hot roller consisting of 7 stands of tandem mills, coiled at a coiling temperature (CT) shown in Table 1, pickled to remove scale and cold rolled at a reduction rate of 70–80%. The cold rolled sheet was continuously annealed under a condition shown in Table 1, and the annealed sheet was subjected to a skin pass rolling to obtain a thin steel sheet. The obtained results are shown in Table 1.

TABLE 1(a)

| | Composition (wt. %) | | | | | | | Coiling temperature (°C.) | Cold rolling reduction rate (%) | Continuous annealing condition | | |
|---|---|---|---|---|---|---|---|---|---|---|---|---|
| | C | Si | Mn | Al | P | Nb | Nb/C | | | Uniform heating | Cooling rate down to 650° C. | Overageing |
| 1 | 0.003 | 0.01 | 0.15 | 0.03 | 0.015 | 0.012 | 4.0 | 680 | 75 | 830° C., 20S | 35° C./S | not effected |
| 2 | 0.004 | 0.01 | 0.15 | 0.02 | 0.013 | 0.034 | 8.5 ([% C] × 8 + 0.002) | 560 | 80 | 880° C., 30S | 17° C./S | not effected |
| 3 | 0.004 | 0.01 | 0.16 | 0.04 | 0.070 | 0.026 | 6.5 | 700 | 82 | 780° C., 30S | 45° C./S | not effected |
| 4 | 0.007 | 0.01 | 0.40 | 0.03 | 0.061 | 0.050 | 7.1 | 640 | 70 | 830° C., 20S | 72° C./S | 350° C., 80S |

TABLE 1(a)-continued

| | Composition (wt. %) | | | | | | | Coiling temperature (°C.) | Cold rolling reduction rate (%) | Continuous annealing condition | | |
|---|---|---|---|---|---|---|---|---|---|---|---|---|
| | C | Si | Mn | Al | P | Nb | Nb/C | | | Uniform heating | Cooling rate down to 650° C. | Overageing |
| 5 | 0.005 | 0.3 | 0.15 | 0.03 | 0.072 | 0.025 | 5.0 | 540 | 78 | 850° C., 30S | 35° C./S | 400° C., 100S |
| 6 | 0.007 | 0.01 | 0.14 | 0.04 | 0.015 | 0.038 | 5.4 | 660 | 75 | 850° C., 30S | 52° C./S | 350° C., 100S |

TABLE 1(b)

| | Skin pass reduction rate (%) | Sheet thickness (mm) | Properties | | | | | |
|---|---|---|---|---|---|---|---|---|
| | | | Yield stress (kg/mm²) | Tensile strength (kg/mm²) | Elongation (%) | $\bar{r}$ | Ageing* index (kg/mm²) | Bake-hardening degree (kg/mm²) |
| 1 | 0.4 | 0.75 | 16 | 30 | 49 | 2.0 | 2.8 | 7.2 |
| 2 | 0.5 | 0.80 | 17 | 32 | 48 | 2.1 | 2.2 | 6.3 |
| 3 | 0.3 | 0.80 | 22 | 37 | 43 | 1.9 | 3.6 | 8.5 |
| 4 | 0.4 | 0.65 | 24 | 39 | 41 | 1.6 | 3.3 | 7.6 |
| 5 | 0.6 | 0.70 | 25 | 41 | 39 | 1.7 | 3.4 | 8.1 |
| 6 | 0.4 | 0.80 | 18 | 33 | 46 | 1.8 | 3.8 | 8.6 |

*Ageing index (increased value of yield stress of a steel sheet by a treatment, wherein the steel sheet is prestrained under a tension of 7.5% and then subjected to an artificial ageing treatment at 100° C. for 30 minutes.)

As seen from Table 1, all the resulting thin steel sheets have an ageing index AI of at least 4 kg/mm², which index is expressed by an increased value of yield stress of the steel sheet in the case where the steel sheet is prestrained under a tension of 7.5% and then subjected to an artificial ageing treatment at 100° C. for 300 minutes. While, all the resulting steel sheets have a BH value of at least 5 kg/mm² and a high $\bar{r}$ value and have a high press moldability.

Steels I and II having a composition shown in the following Table 2 were formed into slabs having a thickness of 220 mm through a pure oxygen-top blowing step by an ID converter, an RH degassing step and a continuous casting step. Each slab was scarfed on its surface, uniformly heated at 1,250° C. for 35 minutes in a heating furnace, and successively hot rolled by means of a continuous type hot mill consisting 4 stands of roughing mills and 7 stands of finishing mills to obtain a hot rolled steel strip having a thickness of 3.2 mm. In this hot rolling, the final reduction rate was 92%, the final rolling velocity was 100–700 m/min, and the hot rolling temperature and coiling temperature were 890° C. and 700° C. respectively in Steel I, 860° C. and 680° C. respectively in Steel II, and 900° C. and 680° C. respectively in steel III.

Each of the resulting hot rolled steel strip was pickled and then cold rolled to produce a cold rolled coil having a thickness of 0.7 mm (reduction rate: 78%, Steels I and II) or a cold rolled coil having a thickness of 0.8 mm (reduction rate: 75%, Steel III). The cold rolled coil was subjected to an annealing according to a heat cycle shown in Table 2 and then to a skin pass rolling at a reduction rate of 0.4% (Steels I and II) or 0.6% (Steel III). The physical properties of the resulting steel coils are shown in the following Table 3.

TABLE 2

| | Chemical composition (wt. %) | | | | | | | Annealing condition | | |
|---|---|---|---|---|---|---|---|---|---|---|
| Steel | C | Si | Mn | P | N | Al | Nb | Uniformly heating temperature | Average cooling rate down to 400° C. | Overageing |
| I | 0.004 | 0.012 | 0.15 | 0.071 | 0.0022 | 0.035 | 0.043 | 930° C. | 17° C./S | not effected |
| II | 0.006 | 0.011 | 0.50 | 0.060 | 0.0042 | 0.045 | 0.057 | 910° C. | 42° C./S | 400° C., 100S |
| III | 0.004 | 0.02 | 0.25 | 0.110 | 0.0034 | 0.035 | 0.024 | 840° C. | 50° C./S (down to 65° C.) | none |

TABLE 3

| Steel | Yield stress (kg/mm²) | Tensile strength (kg/mm²) | Elongation (%) | $\bar{r}$ | Bake-hardening degree (kg/mm²) |
|---|---|---|---|---|---|
| I | 21 | 37 | 44 | 2.3 | 8 |
| II | 23 | 39 | 41 | 1.8 | 9 |
| III | 28 | 45 | 36 | 1.6 | 8.4 (Ageing index: 2.7) |

Then, each of the cold rolled coils in Steels I and II described in Table 2 was annealed at a uniform temperature of 930° C. or 910° C., cooled to 500° C. at an average cooling rate of 12° C./sec or 7° C./sec respectively, and then plated with zinc in a conventional manner by passing the coil through a continuous zinc hot dip plating line. The zinc-plated coil of Steel I was further subjected to an alloying treatment to obtain a final product.

The following Table 4 shows the mechanical properties and the plating performance of the resulting zinc-plated thin steel sheets.

TABLE 4

| Steel | Mechanical properties: Yield stress (kg/mm²) | Tensile strength (kg/mm²) | Elongation (%) | $\bar{r}$ | Bake-hardening degree (kg/mm²) | Plating performance*: Uniformity of plated film | Plate adhesion |
|---|---|---|---|---|---|---|---|
| I | 20 | 36 | 44 | 2.0 | 6 | good | good |
| II | 23 | 39 | 40 | 1.8 | 8 | good | good |

*Comparison with rimmed steel having a good plating performance.

We claim:

1. A thin steel sheet having high baking hardenability and adapted for drawing, having a composition consisting of 0.002–0.008% by weight of C; 0.05–1.2% by weight of Mn; not more than 0.5% by weight of Si; not more than 0.10% by weight of P; 0.01–0.1% by weight of Al, said amount being not less than 8 times amount of N incidentally incorporated into the steel; Nb in an amount within the range of from ((C content)×3) to ((C content)×8+0.02)% by weight; and the remainder being substantially Fe, and having an $\bar{r}$ value greater than 2.0, an ageing index of not higher than 4 kg/mm² and a bake-hardening degree of at least 5 kg/mm².

2. A method of producing a thin steel sheet having a high baking hardenability of at least 5 kg/mm², an ageing index of not higher than 4 kg/mm², an $\bar{r}$ value greater than 2.0, and adapted for drawing, comprising forming a molten steel having a composition containing 0.002–0.008% by weight of C; 0.05–1.2% by weight of Mn; not more than 0.5% by weight of Si; not more than 0.10% by weight of P; 0.01–0.10% by weight of Al, said amount being not less than 8 times amount of N incidentally incorporated into the steel; and Nb in an amount within the range of from ((C content)×3) to ((C content)×8+0.02)% by weight into a slab, hot rolling the slab, cold rolling the hot rolled sheet, subjecting the cold rolled sheet to a continuous annealing under a condition of a temperature of 750°–900° C. and a time of at least 10 seconds, and cooling the annealed sheet under a condition that the annealed sheet is cooled to a temperature of not higher than 650° C. at an average cooling rate of at least 10° C. per second.

3. A method according to claim 2, wherein the cold rolling is carried out at a reduction rate of 60–90%.

4. A method according to claim 2 or 3, wherein the average cooling rate is at least 30° C. per second.

5. A thin steel sheet for drawing, having a composition consisting of 0.002–0.015% by weight of C; 0.04–1.5% by weight of Mn; not more than 1.2% by weight of Si; not more than 0.10% by weight of P; 0.001–0.01% by weight of N; 0.01–0.10% by weight of Al; Nb in an amount within the range of from ((C content)×2) to ((C content)×8+0.02)% by weight; and the remainder being substantially Fe, and having an $\bar{r}$ value greater than 2.0, an ageing index of not higher than 4 kg/mm² and a bake-hardening degree of at least 5 kg/mm².

6. A method of producing a thin steel sheet having a high baking hardenability of at least 5 kg/mm², an ageing index of not higher than 4 kg/mm², an $\bar{r}$ value greater than 2.0, and adapted for drawing, comprising forming a molten steel having a composition containing 0.002–0.015% by weight of C; 0.04–1.5% by weight of Mn; not more than 1.2% by weight of Si; not more than 0.10% by weight of P; 0.001–0.01% by weight of N; 0.01–0.10% by weight of Al; and Nb in an amount within the range of from ((C content)×2) to ((C content)×8+0.02)% by weight into a slab, hot rolling the slab, cold rolling the hot rolled sheet, subjecting the cold rolled sheet to a continuous annealing at a uniform temperature between 900° C. and the $Ac_3$ point, and cooling the annealed sheet under a condition that the annealed sheet is cooled to a temperature of not higher than 600° C. at an average cooling rate of at least 1° C. per second.

7. A method according to claim 6, wherein the hot rolling is carried out at a rolling velocity of at least 40 m/min.

8. A method according to claim 6 or 7, wherein the cold rolling is carried out at a reduction rate of 60–90%.

9. A method according to claim 6 or 7, wherein the average cooling rate is at least 10° C. per second.

10. A method of producing a thin steel sheet having a high baking hardenability of at least 5 kg/mm², an ageing index of not higher than 4 kg/mm², an $\bar{r}$ value greater than 2.0, and adapted for drawing and adapted to be used as a starting sheet for plating, comprising forming a molten steel having a composition containing 0.002–0.015% by weight of C; 0.04–1.5% by weight of Mn; not more than 0.5% by weight of Si; not more than 0.10% by weight of P; 0.001–0.01% by weight of N; 0.01–0.10% by weight of Al; and Nb in an amount within the range of ((C content)×2) to ((C content)×8+0.02)% by weight into a slab, hot rolling the slab, cold rolling the hot rolled sheet, subjecting the cold rolled sheet to a continuous annealing at a uniform temperature between 900° C. and the $Ac_3$ point, and cooling the annealed sheet under a condition that the annealed sheet is cooled to a temperature of not higher than 600° C. at an average cooling rate of at least 1° C. per second.

11. A thin steel sheet for drawing, having a composition consisting of 0.002–0.015% by weight of C; 0.04–1.5% by weight of Mn; not more than 1.2% by weight of Si; not more than 0.12% by weight of P; 0.001–0.01% by weight of N; 0.01–0.10% by weight of Al; Nb in an amount within the range of from ((C content)×2) to ((C content)×6)% by weight; and the remainder being substantially Fe, and having an $\bar{r}$ value greater than 2.0, an ageing index of not higher than 4 kg/mm² and a bake-hardening degree of at least 5 kg/mm².

* * * * *